US008258705B2

(12) United States Patent
Butteris et al.

(10) Patent No.: US 8,258,705 B2
(45) Date of Patent: Sep. 4, 2012

(54) SCOTOPICALLY ENHANCED EMERGENCY LIGHT AND CONTROL THEREOF

(75) Inventors: Jamey L. Butteris, Simpsonville, SC (US); Thomas K. Heaton, Greenville, SC (US); Michael A. Starinki, Greer, SC (US)

(73) Assignee: Hubbell Incorporated, Shelton, CT (US)

( * ) Notice: Subject to any disclaimer, the term of this patent is extended or adjusted under 35 U.S.C. 154(b) by 521 days.

(21) Appl. No.: 12/453,126

(22) Filed: Apr. 29, 2009

(65) Prior Publication Data

US 2010/0277070 A1 Nov. 4, 2010

(51) Int. Cl.
*H05B 37/00* (2006.01)

(52) U.S. Cl. ..... 315/86; 315/291; 315/307; 315/312; 307/64; 307/86

(58) Field of Classification Search ..... 315/86, 315/291, 307, 312; 307/64, 86
See application file for complete search history.

(56) References Cited

U.S. PATENT DOCUMENTS

| | | | | |
|---|---|---|---|---|
| 5,697,175 | A * | 12/1997 | Schwartz | 40/552 |
| 5,929,781 | A * | 7/1999 | Vosika | 340/12.22 |
| 6,188,182 | B1 | 2/2001 | Nickols et al. | |
| 6,220,722 | B1 | 4/2001 | Begemann | |
| 6,329,760 | B1 | 12/2001 | Bebenroth | |
| 6,499,860 | B2 | 12/2002 | Begemann | |
| 6,614,579 | B2 | 9/2003 | Roberts et al. | |
| 6,791,283 | B2 | 9/2004 | Bowman et al. | |
| 7,015,636 | B2 | 3/2006 | Bolta | |
| 7,088,059 | B2 | 8/2006 | McKinney et al. | |
| 7,204,606 | B2 | 4/2007 | Brass et al. | |
| 7,234,844 | B2 * | 6/2007 | Bolta et al. | 362/294 |
| 7,690,802 | B2 * | 4/2010 | Higley et al. | 362/20 |
| 7,771,087 | B2 * | 8/2010 | Wilcox et al. | 362/294 |
| 2005/0057353 | A1 * | 3/2005 | Barrieau et al. | 340/506 |
| 2006/0146553 | A1 * | 7/2006 | Zeng et al. | 362/488 |
| 2007/0147025 | A1 | 6/2007 | Shirey | |
| 2007/0211461 | A1 * | 9/2007 | Harwood | 362/232 |
| 2008/0037257 | A1 | 2/2008 | Bolta | |
| 2008/0089069 | A1 | 4/2008 | Medendorp | |
| 2008/0212319 | A1 | 9/2008 | Klipstein | |
| 2008/0212336 | A1 | 9/2008 | Chae | |

* cited by examiner

*Primary Examiner* — Jason M Crawford
(74) *Attorney, Agent, or Firm* — Stanislav Torgovitsky; Mark S. Bicks; Alfred N. Goodman

(57) ABSTRACT

System and method are provided for controlling emergency lighting where emergency lights turn on when main source of power goes out for controlling emergency lighting to conserve energy utilized by the emergency light, while maintaining good visibility of the emergency lighting. Solid state lighting, such as LED, is used within an emergency light to add light in blue wavelength region matching the light output to the most sensitive of wavelength response of the human eve to increase color perception and allows faster response time. Electrical current to the device and light output are reduced while LED light tends to increase its blue wavelength component as it is dimmed thus increasing effective light output. After a predetermined time, the light is purposefully dimmed to conserve energy and to allow the eye to slowly and safely adjust to the new lighting conditions. By reducing electrical current, energy storage batteries may be smaller than for similar unit that maintains constant light output.

20 Claims, 8 Drawing Sheets

SCOTOPICALLY ENHANCED EMERGENCY LIGHT AND CONTROL THEREOF

BACKGROUND OF THE INVENTION

1. Field of the Invention

The present invention generally relates to systems and methods for controlling emergency lighting where emergency lights turn on when main source of power goes out. More particularly, the present invention relates to lighting systems and methods for controlling emergency lighting to conserve energy utilized by the emergency light, while maintaining good visibility of the emergency lighting.

2. Discussion of the Background

An important consideration for emergency lighting is visibility. For example, U.S. Pat. No. 7,234,844 to Bolta et al., the entire disclosure of which is hereby incorporated by reference, describes emergency lighting fixtures that incorporate light emitting diode (LED) lighting sources made with scotopically rich primary colors which increase perceived light even under a low lumen output, because the human eye responds more to blue light and less to yellow/red light. That is, Bolta et al. describe various blends and configurations of color LEDs for emergency lighting that operate at reduced lumen output while increasing the eye's ability to respond to low levels of light by the use of primary scotopic color of LEDs.

Another important consideration in any lighting application is conservation of energy. For emergency lighting conservation of energy becomes even more critical because emergency lighting is often operated using back-up battery power, or other emergency power sources having a limited available power over a given duration of time. Thus, it is desirable to reduce power consumption by emergency lighting so as to extend the duration of available emergency lighting. However, the reduction of power must be mitigated by potentially reduced visibility as the light dim in such during emergency lighting application.

Conventional emergency light systems that utilize filament based lighting sources (light bulb) not only dim, but also shifts in color temperature from a white light to a much more red light, when power reduced. Since human eyes respond better to colors in the blue/green spectrum than in the red spectrum, a filament bulb will not only get dimmer, but will be perceived as dimmer than it actually is. Accordingly, while power consumption is reduced, so is the visibility.

On the other hand, while conventional LED-based emergency lighting systems, for example as described in Bolta et al, operate at a reduced power compared to normal lighting conditions, this reduced power is maintained at a constant level not allowing for further power conservation to be achieved.

SUMMARY OF THE INVENTION

Exemplary embodiments of the present invention address at least the above problems and/or disadvantages and provide at least the advantages described below. Accordingly, an aspect of the present invention is to provide an emergency lighting system and method where power consumption of emergency lights is reduced over time while maintaining scotopically enhanced visibility.

Exemplary embodiments of the present invention provide a system and method including a light source comprising at least one LED configured to dim with very little to no color shift when power thereto is reduced, and a controller for controlling power provided to the LED as a function of time.

Exemplary implementations of certain embodiments of the present invention further include a circuit for determining presence of AC power and declaring an emergency event upon absence thereof for a period of time.

According to another exemplary implementation of certain embodiments of the present invention, the controller causes the current to the LED to be reduced over a time period when an emergency event is declared.

According to another exemplary implementation, an emergency power source is any one, or combination, of a battery, a power generator, or a charged capacitor.

According to yet another exemplary implementation, the controller creates a control signal comprising a voltage that is converted to a current to the LED, and alters the voltage pattern to cause the current to be reduced in the LED.

According to yet other exemplary embodiments of the present invention, the light source comprises plurality of LED where the current to at least one, some, or all of the LED is controlled by the controller.

According to yet other exemplary embodiments of the present invention, a light fixture is provided that includes a light source comprising a housing, a reflector and a heat sink with at least one LED configured to dim with very little to no color shift when power thereto is reduced, and a controller for controlling power provided to the LED as a function of time.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
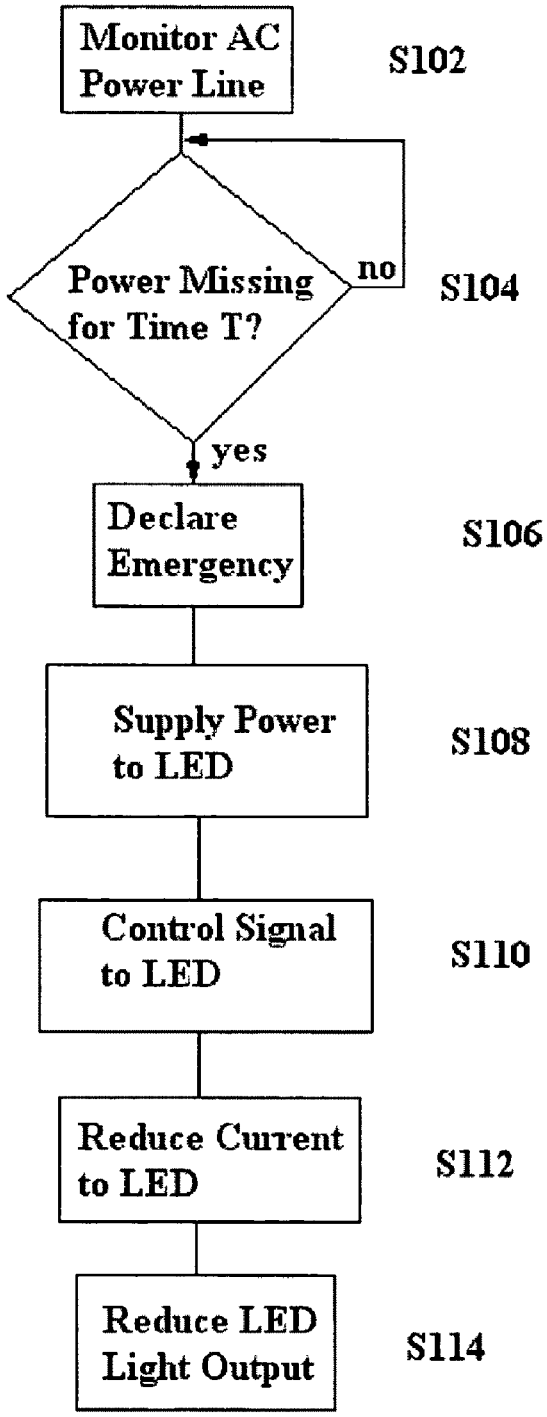
FIG. 1 shows an operational flowchart of system according to an exemplary embodiment of the present invention.

Referring now to the drawings, wherein like reference numerals designate identical or corresponding parts throughout the several views, embodiments of the present invention are shown in schematic detail.

The matters defined in the description such as a detailed construction and elements are nothing but the ones provided to assist in a comprehensive understanding of the invention. Accordingly, those of ordinary skill in the art will recognize that various changes and modifications of the embodiments described herein can be made without departing from the scope and spirit of the invention. Also, well-known functions or constructions are omitted for clarity and conciseness.

According to exemplary embodiment of the present invention, a system and method are provided where emergency lighting is activated and powered as explained below with reference to exemplary process flow diagram of FIG. 1.

Figure 2:
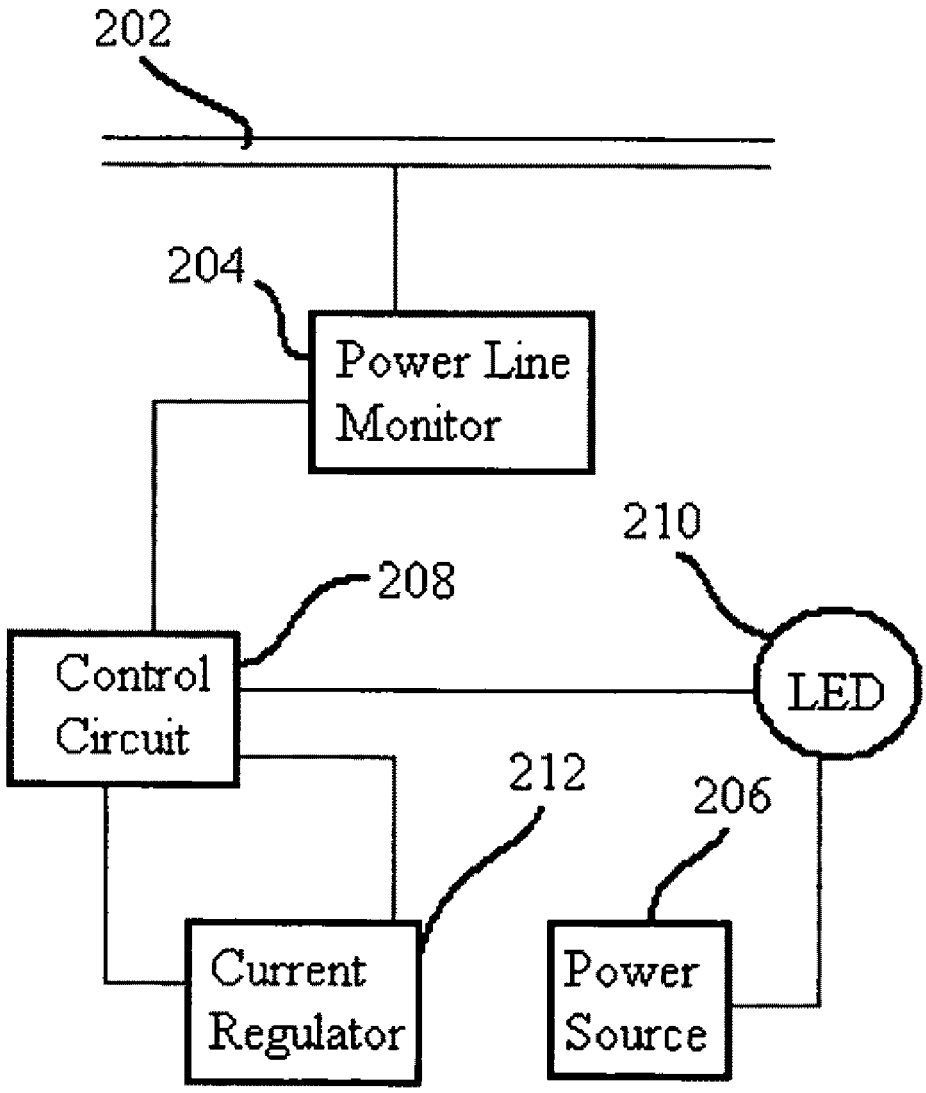
FIG. 2 is a block diagram of a system according to an exemplary embodiment of the present invention.

As illustrated in the example of FIG. 1, and with reference to FIG. 2, AC power line 202 is monitored by a power line monitoring circuit 204 for the presence of power thereon (S102). Upon determination that AC power is missing for a period of time T1 (S104), an emergency event is declared (S106) and power is supplied to LED (S108) from a power source 206. After LED is powered on, a control signal is fed to the LED (S110) from a control circuit 208 causing current to LED to be reduced (S112) over a time period T2 resulting in a gradual reduction of light output (S114) by the LED 210. Optionally, a current regulating circuit 212 may be provided to regulate current output to LED 210 at the control of circuit 208.

Figure 3A:
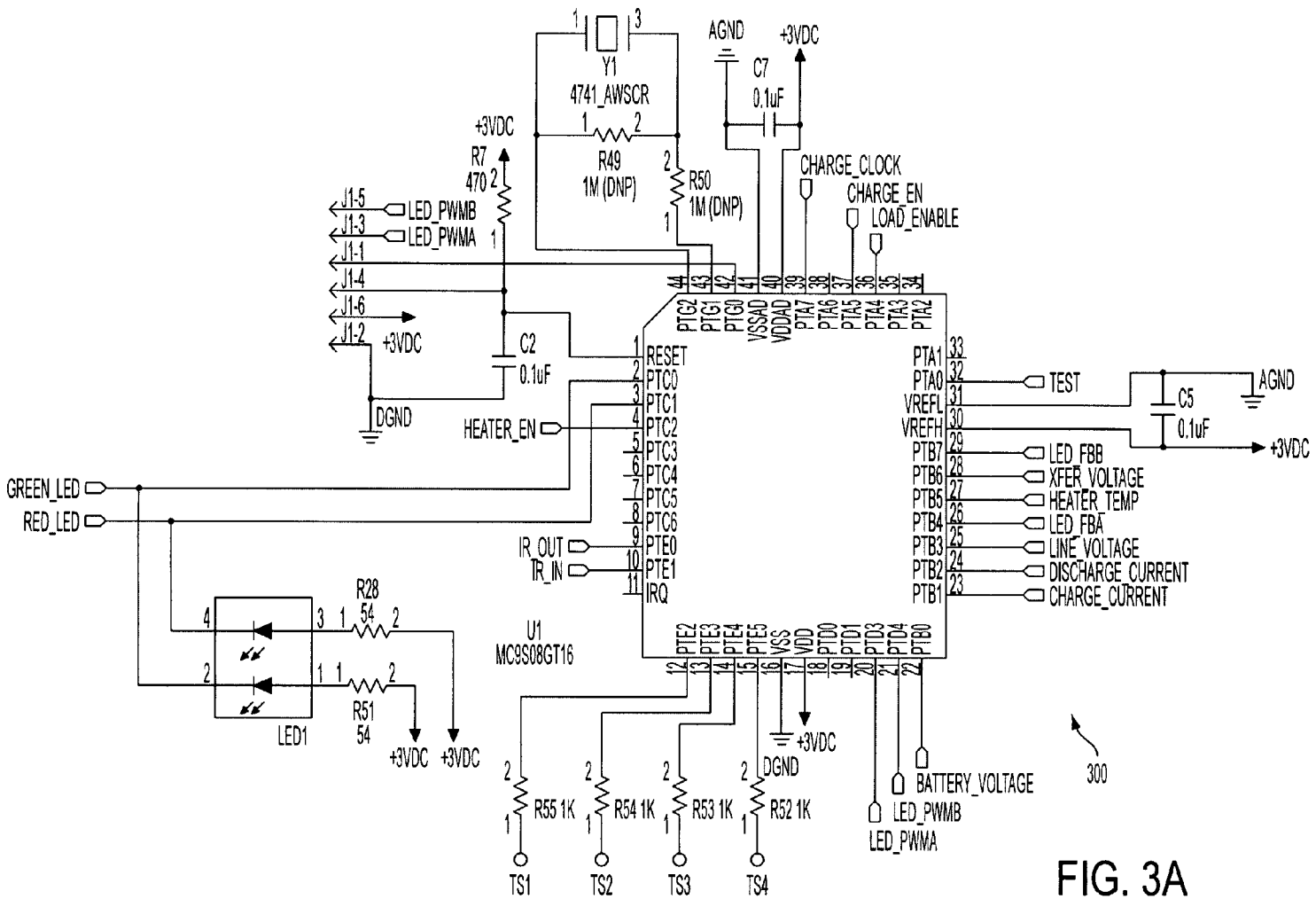
FIGS. 3A-3C (FIG. 3B includes FIGS. 3B-1 and 3B-2) show a circuit diagram of an exemplary implementation of embodiments of the present invention.
Figures 1, 3B:
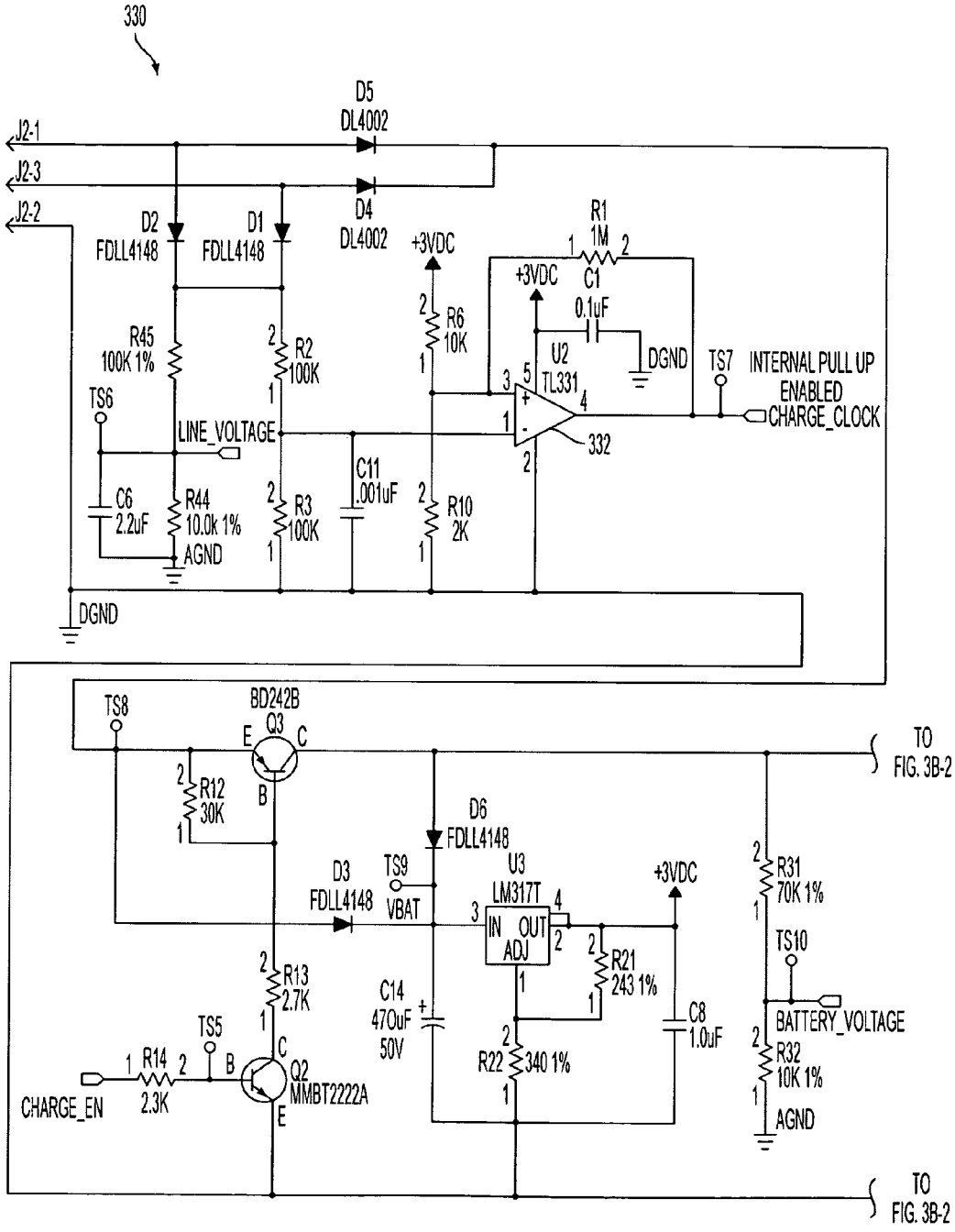
Figures 2, 3B:
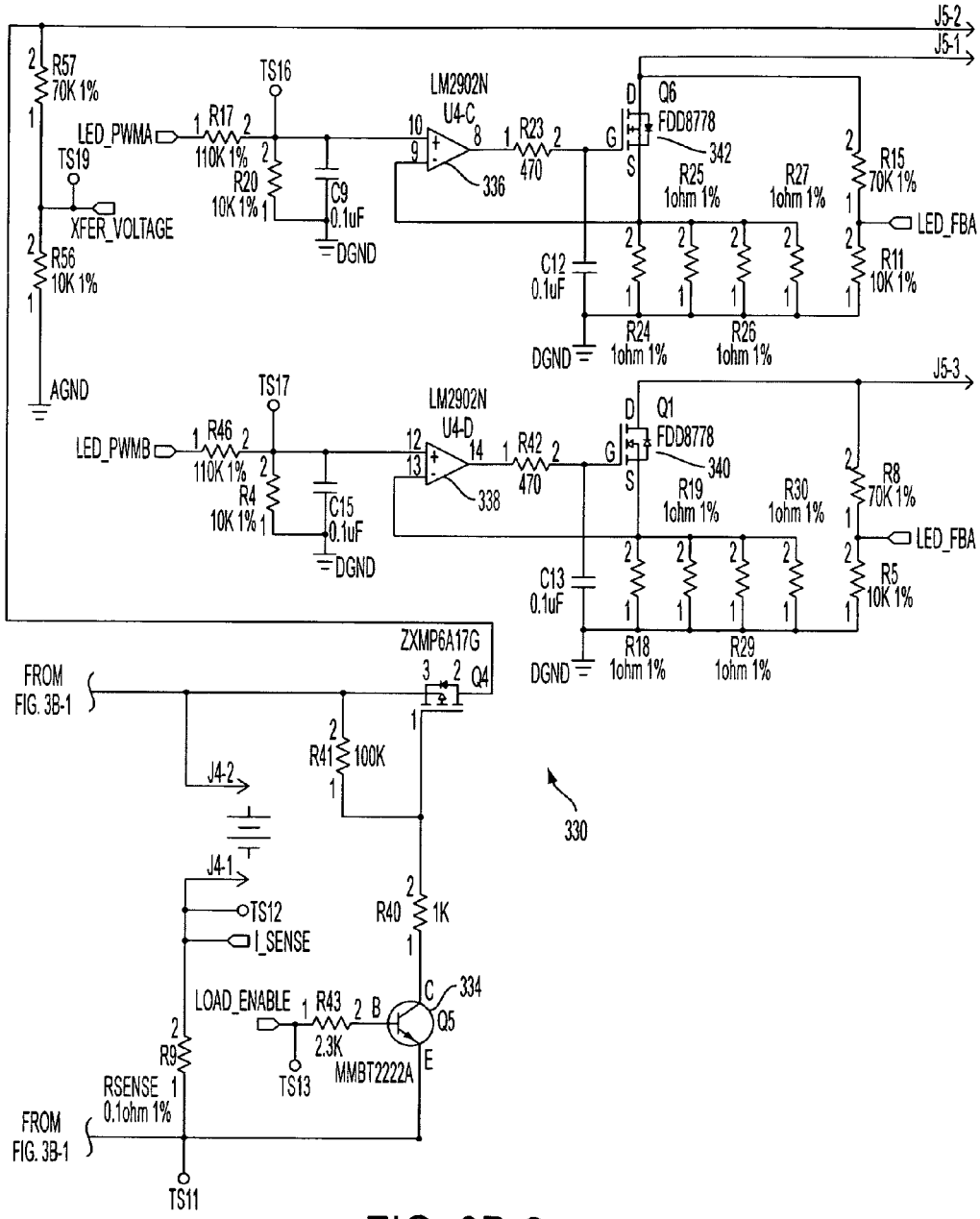
Figure 3C:
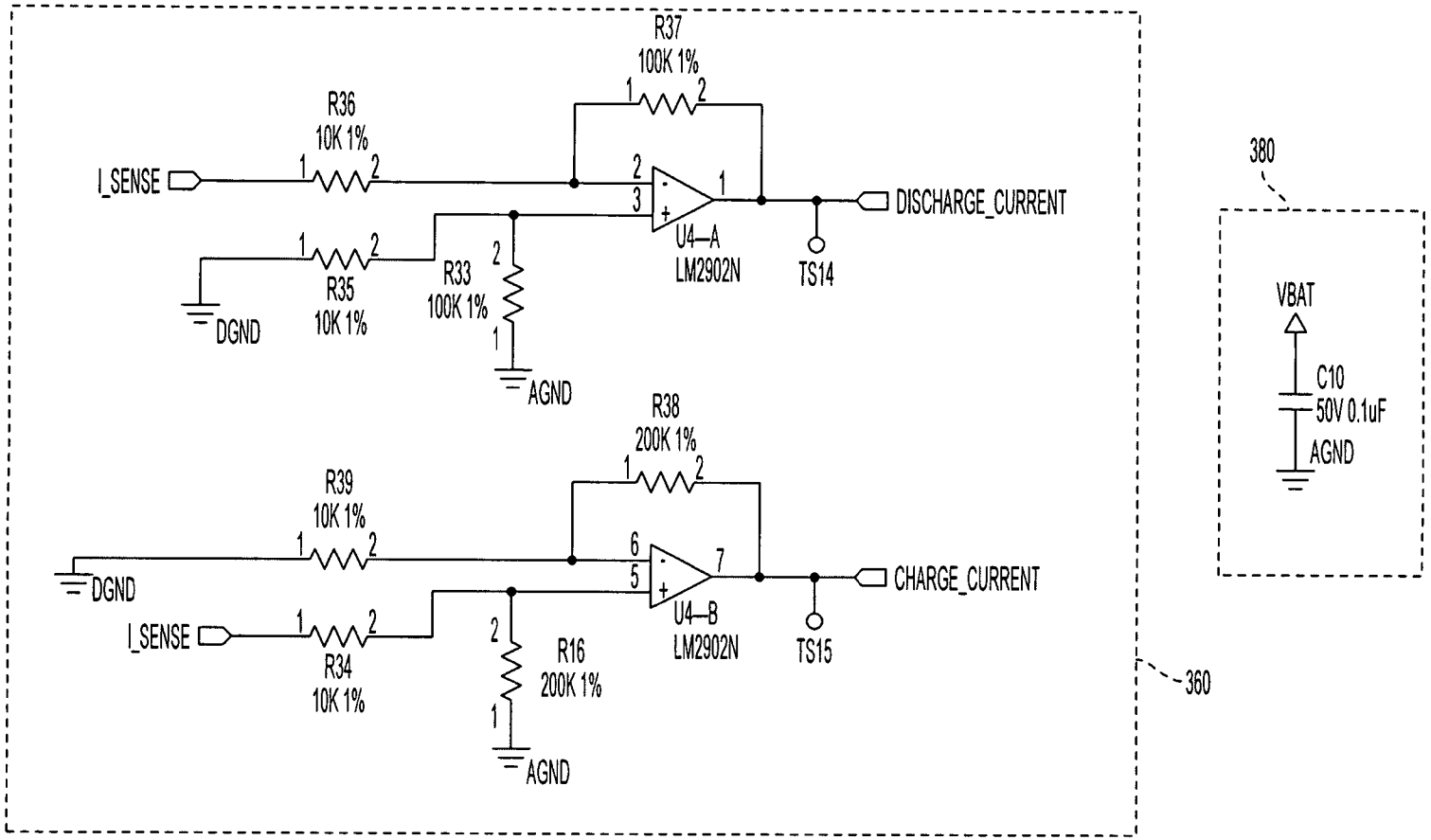

Referring to FIGS. 3A-3C, a circuit diagram of an exemplary implementation of emergency light control according to embodiments of the present invention includes a microprocessor controller 300 (as shown in FIG. 3A), a drive circuit 330 (as shown in FIG. 3B) for detecting presence if AC power and supplying power to LEDs based on control signal from the controller 300, a current regulator 360 (as shown in FIG. 3C) to regulate the current applied to LEDs as commanded by the controller 300, and an emergency power source 380 (as shown in FIG. 3C).

That is, according to an exemplary implementation, a controller (U1) 300 determines a control signal to the LEDs (not shown, but connected to J5-1 and J5-3 of FIG. 3B). The presence of AC power is determined on IC (U2) 332 (see FIG. 3B). When AC is missing for a predetermined period of time, an emergency event is declared. Controller (U1) 300 switches on the LED power via transistor (Q5) 334 (see FIG. 3B). Then, controller (U1) 300 creates a control signal (LED_PWMA and LED_PWMB of FIG. 3A) fed to the dual LED path (LED_PWMA and LED_PWMB of FIG. 3B). This control signal is a voltage that is converted to a current through the combination of ICs (U4-C/U4-D) 336/338 and transistors (Q6/Q1) 342/340 to the LEDs (not shown, off board on connector J5-1 and J5-3). As time progresses U1 alters the voltage pattern to cause the current to be reduced in the LEDs (off board on connector J5). This results in a reduction in light output on the LEDs.

Figure 4B:
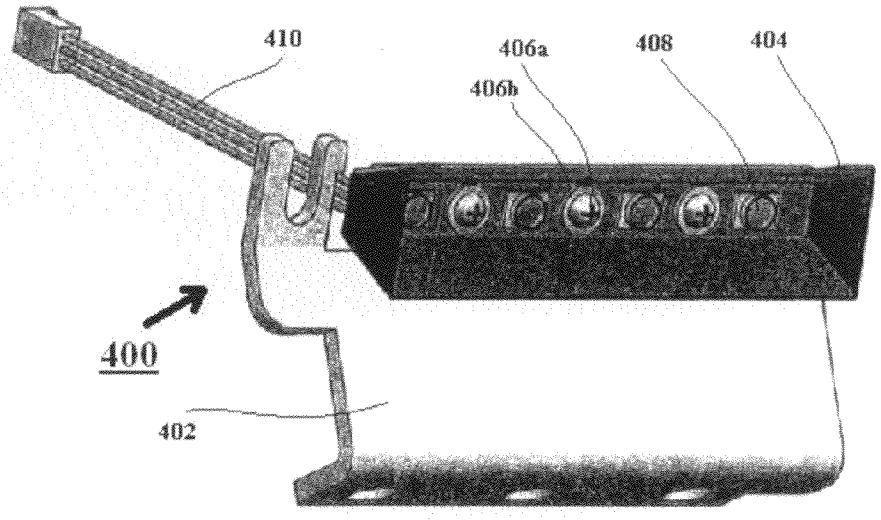
FIGS. 4A and 4B illustrate an example of a light fixture according to an exemplary implementation of certain embodiments of the present invention.
Figure 4A:
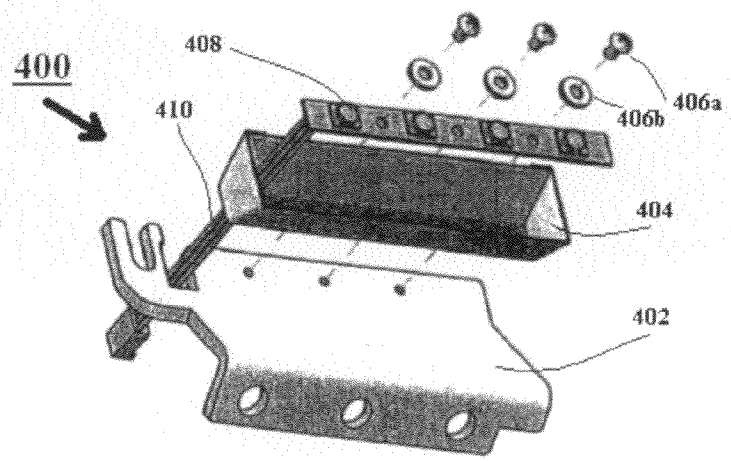

An example of an emergency light fixture 400 incorporating LED and power control circuitry according to an embodiment of the present invention is illustrates in FIGS. 4A and 4B where LEDs 408 are mounted on a reflector/heat sink 404, which is attached to a bracket 402 by means of screws/washers 406*a/b*. Connection of the light fixture 400 can be achieved by means line(s) 410.

Figure 5:
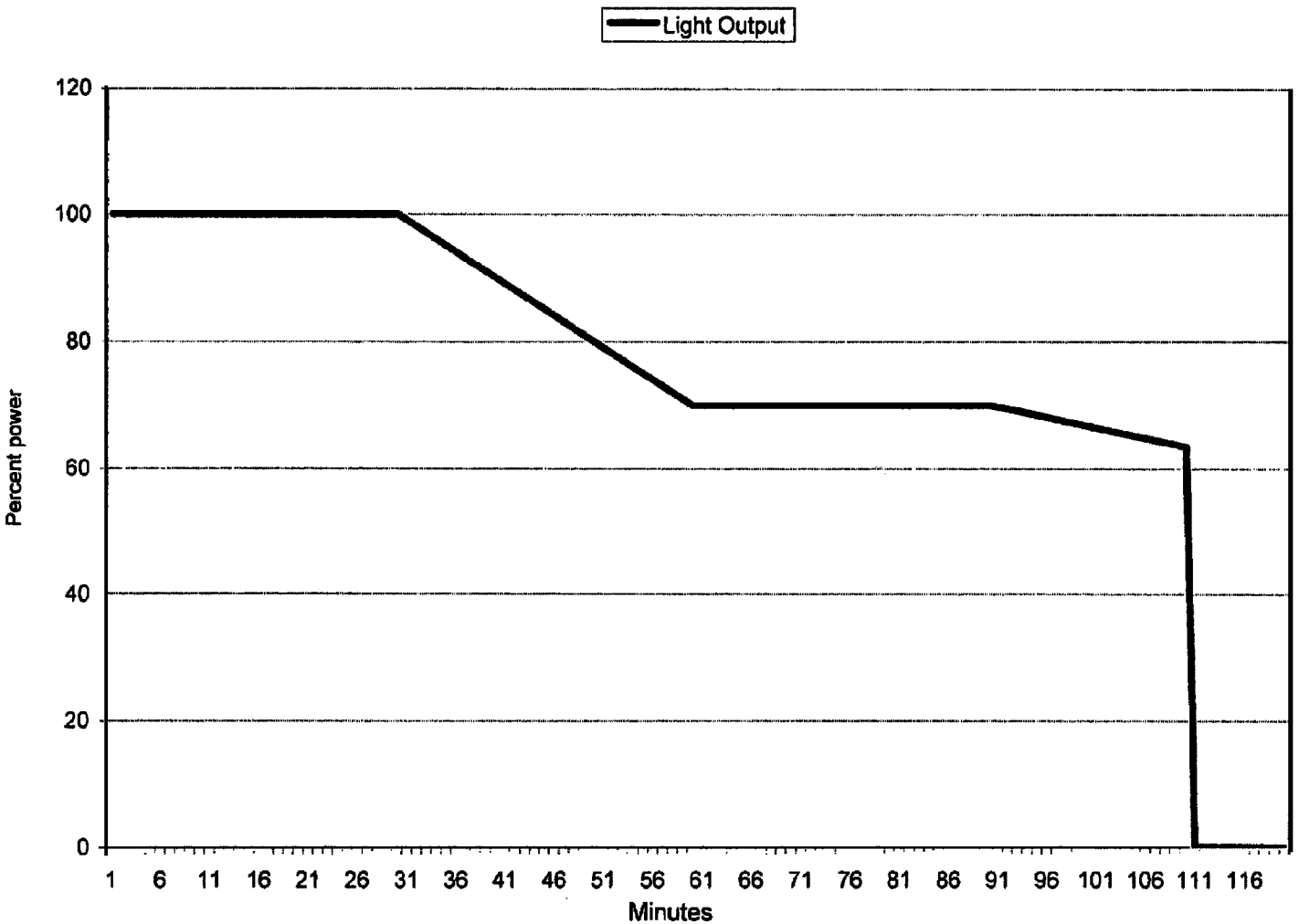
FIG. 5 illustrates an exemplary profile of light output according to embodiments of present invention.

In an exemplary implementation, as describe with reference to FIG. 5, the light output is intentionally reduced after a certain time (for example, 30 minutes) into an emergency to accommodate the human eye response time to react to an abrupt change in overall illumination. After this time (for example, 30 minutes) the light output is gradually reduced to conserve power and maintain code compliance while keeping in mind the photopic-mesopic-scotopic transition timing.

As shown in the example of FIG. 5, the light is reduced from 100% to 70% gradually across the next 30 minutes. The light is then steady for the remaining time until the batteries are exhausted (for example, an additional 30 minutes minimum)

In an exemplary implementation, the voltage is reduced indirectly. That is, the LED light source is directly sensitive to electrical current which is reduced from 100% to, for example, 60% during the discharge time. The voltage is disproportionately reduced during this time and is incidental. A microcomputer, such as controller 300, provides the timing logic and control of electrical current and light output. According to yet another exemplary implementation, there is no feedback mechanism to measure output light directly as it is inferred from electrical current.

According to exemplary embodiments of the present invention, the use of solid state lighting over an incandescent light within an emergency light allows a competitive advantage in several ways. The first advantage is the addition of light in the blue wavelength region. This matches the light output to the most sensitive of wavelength response of the human eve. This increases color perception and allows faster response time to danger. The second advantage is the ability to reduce the electrical current to the device and, subsequently, to reduce the actual light output. With an incandescent lamp, this reduction in current causes a substantial shift in the light wavelength into the deep red/infrared. This moves the light output from the most sensitive area of human perception to the area of lesser effectiveness. By contrast, the LED light tends to increase its blue wavelength component as it is dimmed. This increases the effective light output. After a predetermined time, the light is purposefully dimmed to conserve energy and to allow the eye to slowly and safely adjust to the new lighting conditions. The third advantage is that by the use of this electrical current reduction, the energy storage batteries may be smaller than for a similar unit that maintains constant light output. This results in a smaller, less expensive product.

Numerous additional modifications and variations of the present invention are possible in light of the above teachings. It is therefore to be understood that within the scope of the appended claims, the present invention may be practiced otherwise than as specifically described herein.

We claim:

1. A light system comprising:

a light source comprising at least one light emitting diode (LED); and a controller that outputs a control signal to the LED to correspondingly vary luminous output of the LED, wherein the spectral output of the LED remains substantially unchanged scotopically when the luminous output of the LED is varied.

2. The light system of claim 1, further comprising a power monitoring circuit connected to an AC power source and, if power from the AC power source is absent for a certain period of time, providing an indication to the controlled of an emergency event.

3. The light system of claim 2, wherein, if the controller receives the indication of the emergency event, the control signal comprises a first control signal to the LED to maintain the luminous output of the LED at the first level for a first period of time.

4. The light system of claim 2, wherein, if the controller receives the indication of the emergency event, the control signal comprises a second control signal to the LED to reduce the luminous output of the LED from a first level to a second level over a second period of time.

5. The light system of claim 4, wherein, when the luminous output of the LED is reduced to the second level, the control signal comprises a third control signal to the LED to maintain the luminous output of the LED at the second level.

6. The system of claim 4, wherein the first level of output is essentially at 100%, the second level of output is essentially at 70%, the second period of time is approximately 30 minutes, and the reduction of the luminous output of the LED from the first level to the second level is essentially gradual over the second time period.

7. The light system of claim 1, further comprising a power source for providing power to the LED.

8. The light system of claim 7, further comprises a voltage to current converter, wherein the control signal output form the controller comprises a voltage and the voltage to current converter converts the voltage to a current and outputs the current to the LED, and wherein the controller varies a pattern of the voltage to vary the current output to the LED to correspondingly vary the luminous output of the LED.

9. The light system of claim 8, further comprising a current regulator connected to the controller for regulating the current output to the LED.

10. The system of claim 8, wherein the light source comprises a plurality of LEDs, the system further comprising a plurality of voltage to current converters each configured to convert the voltage output from the controller to the current output to the respective LEDs.

11. The system of claim 1, wherein the light source comprises a plurality of LEDs, and the controller outputs the control signal to the LEDs to correspondingly vary luminous output of the LEDs.

12. The system of claim 1, further comprising:

a reflector configure with respect to the light source to direct light output from the light source;

a heat sink configured to dissipate heat associated with the LED; and a mounting bracket for attaching the light source.

13. A method for controlling output of light, the method comprising:

outputting light from at least one light emitting diode (LED);

generating a control signal supplied to the LED to correspondingly vary luminous output of the LED, wherein the spectral output of the LED remains substantially unchanged scotopically when the luminous output of the LED is varied.

14. The method of claim 13, further comprising:

monitoring power output from an AC power source; and if power from the AC power source is absent for a certain period of time, generating an indication of an emergency event.

15. The method of claim 14, wherein, if detecting the indication of the emergency event, the generating of the control signal comprises outputting a first control signal to the LED to maintain the luminous output of the LED at the first level for a first period of time.

16. The method of claim 14, wherein, if detecting the indication of the emergency event, the generating of the control signal comprises outputting a second control signal to the LED to reduce the luminous output of the LED from a first level to a second level over a second period of time.

17. The method of claim 16, wherein, when the luminous output of the LED is reduced to the second level, the generating of the control signal comprises outputting a third control signal to the LED to maintain the luminous output of the LED at the second level.

18. The method of claim 16, wherein the first level of output is essentially at 100%, the second level of output is essentially at 70%, the second period of time is approximately 30 minutes, and the reduction of the luminous output of the LED from the first level to the second level is essentially gradual over the second time period.

19. The method of claim 13, wherein the generating of the control signal supplied to the LED comprises:

generating a voltage pattern;

converting the voltage pattern to a current; and supplying the current to the LED, wherein varying the voltage pattern varies the current supplied to the LED to correspondingly vary the luminous output of the LED.

20. The method of claim 13, further comprising outputting light from a plurality of light emitting diodes (LEDs), wherein the generating of the control signal further comprises supplying the control signal to the LEDs to correspondingly vary luminous output of the LEDs, wherein the spectral output of the LEDs remains substantially unchanged scotopically when the luminous output of the LEDs is varied.

* * * * *